United States Patent [19]

Meijer

[11] Patent Number: 4,977,742

[45] Date of Patent: Dec. 18, 1990

[54] STIRLING ENGINE WITH INTEGRATED GAS COMBUSTOR

[75] Inventor: Roelf J. Meijer, Ann Arbor, Mich.

[73] Assignee: Stirling Thermal Motors, Inc., Ann Arbor, Mich.

[21] Appl. No.: 341,424

[22] Filed: Apr. 21, 1989

[51] Int. Cl.[5] ..... F02G 1/04

[52] U.S. Cl. ..... 60/525; 60/517

[58] Field of Search ..... 60/517, 524, 525; 431/173, 351, 352, 354

[56] References Cited

U.S. PATENT DOCUMENTS

| | | | |
|---|---|---|---|
| 2,692,014 | 10/1954 | MacCracken | 431/352 X |
| 2,850,875 | 9/1958 | Gahwyler | 431/351 X |
| 3,492,813 | 2/1970 | Meijer | 60/525 |
| 3,845,626 | 11/1974 | Berntell et al. | 60/525 |
| 3,890,785 | 6/1975 | Torsten | 60/525 |
| 3,898,841 | 8/1975 | Kanzler | 60/525 |
| 4,008,568 | 2/1977 | Spears | 431/352 X |
| 4,045,978 | 9/1977 | Abrams | 60/525 |
| 4,085,588 | 4/1978 | Reams et al. | 60/517 |
| 4,276,018 | 6/1981 | Robbins | 431/352 |
| 4,639,212 | 1/1987 | Watanabe et al. | 60/517 X |

*Primary Examiner*—Allen M. Ostrager

*Attorney, Agent, or Firm*—Harness, Dickey & Pierce

[57] ABSTRACT

A Stirling engine having multiple cylinders arranged in a square cluster with a gas combustor devices for each cylinder integrated into the engine. The combustor devices include individual combustion chamber tubes for each of the cylinder of the engine. Air is introduced into the chambers in a manner which generates a tangential air flow which mixes with a combustible gas injected from a gas nozzle in the center of the tube which provides a highly turbulent combustible gas flow regime. Combustion gases pass through the Stirling engine heat exchangers to transfer heat to the engine. Exhaust gas heats inlet air through a counterflow heat exchanger. The relatively small size of the combustion chamber tubes enables the components of the combustion chambers to reach an equilibrium temperature repidly and minimizes thermal distortion of the components.

7 Claims, 2 Drawing Sheets

STIRLING ENGINE WITH INTEGRATED GAS COMBUSTOR

BACKGROUND AND SUMMARY OF THE INVENTION

This invention relates to a multiple cylinder Stirling engine and particularly to one that has gas combustors which act as heat sources for the engine which are integrated into the structure of the engine.

Stirling cycle engines may be powered directly by a source of heat such as from solar energy sources, combusted gas, etc. The output mechanical energy of the engine can be used to do direct work or for the generation of electrical energy, etc. In some applications, it is desirable to use flue gases from a combustible fuel to provide the heat input energy for the engine. In one type of prior art Stirling engine, a combustion apparatus remote from the engine is used in which the heat energy is transferred through a heat transport mechanism such as a liquid metal heat pipe. Although such devices perform very satisfactorily and do offer thermodynamic benefits, they have, however, a larger heat capacity of the heating system which requires a considerable warm-up time. For some applications, this is not desirable.

Other types of prior art Stirling engines incorporate one large gas combustor in combination with an integrated heater head of a number of working cylinders. Such heater heads are not very suitable for volume production due to the complexity and long brazing time of the tubes in the massive heater heads.

This invention is directed toward a Stirling engine with multiple gas combustors that are integrated into the structure of the engine to provide a compact and efficient energy conversion machine. The system eliminates the requirement of a separate heat pipe for transferring heat from a remote source. Individual combustion chambers are provided for each of the cylinders of a multiple cylinder Stirling engine. The relatively small size of the combustion chamber allows a circular manifold which is connected on a bundle of small tubes via one or more hot connecting duct(s) to the cylinder.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
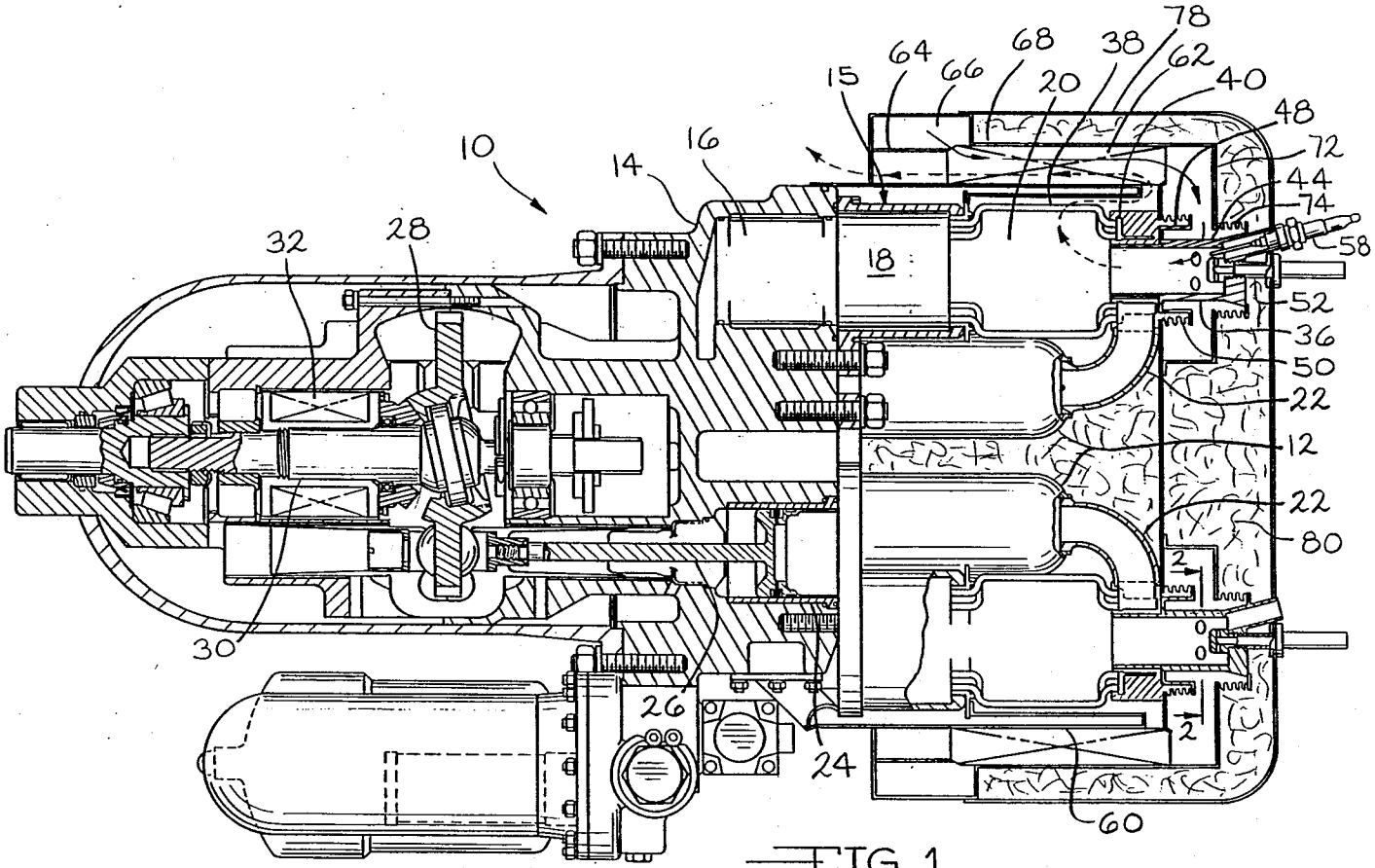
FIG. 1 is a longitudinal partially cross-sectional and partially elevational view of a Stirling engine with integrated gas combustors in accordance with this invention.

A Stirling engine in accordance with this invention is shown in FIG. 1 and is generally designated by reference number 10. Engine 10 includes four substantially parallel piston cylinders 12 which are disposed in a square cluster about a central axis within drive mechanism housing 14. Associated with each piston cylinder

12 and located on an end surface of drive mechanism housing 14 are heat transfer stacks 15 comprising cooler 16, regenerator 18, and heat exchanger 20. Cooler 16, regenerator 18 and heat exchanger 20 are arranged end-to-end to form a cylindrical column which communicates with piston cylinder 12 via connecting duct 22.

Located within each piston cylinder 12 is a movable piston 24 and a connecting rod 26. Swashplate 28 converts the reciprocating axial motion of pistons 24 to rotary motion of output shaft 30. The angle of swashplate 28 can be changed by rotating the swashplate relative to output shaft 30 to vary the output of the engine. This rotation is effected by a stroke converter 32. Additional details of the operation of Stirling engine 10 can be obtained by reference to issued U.S. Pat. No. 4,481,771 which is hereby incorporated by reference and is assigned to the assignee of this invention.

Heat is inputted to Stirling engine 10 through separate combustor assemblies 36 associated with each of heat exchangers 20. As shown, heat exchangers 20 are comprised of a plurality of relatively thin and flexible tubes 38 through which the working fluid (e.g., helium) of Stirling engine 10 flows. The working fluid flowing through tubes 38 collects at annular manifold 40 which communicates with connecting duct 22.

Figure 2:
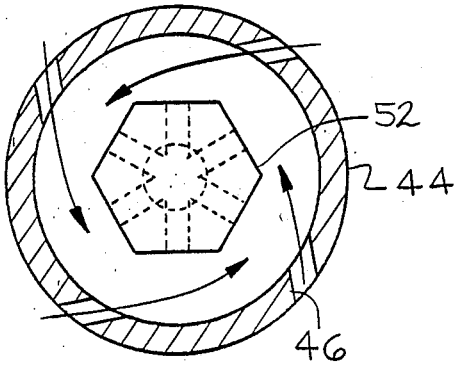
FIG. 2 is a cross-sectional view taken along line 2—2 of FIG. 1 showing the air inlet passages of the combustor and the gas nozzle.

Each combustor assembly 36 includes combustion chamber tube 44 which has a plurality of generally tangential air inlets 46, best shown with reference to FIG. 2. Air inlets 46 are shaped to generate a swirling tangential flow of air entering cylinder 44 as shown by the arrows in FIG. 2. Flange 48 surrounds tube 44 near its longitudinal midpoint and forms a surface for attachment of bellows 50 which provides a gas seal, but permits relative movement of the components as they are exposed to thermal gradients and expansion.

Figure 3:
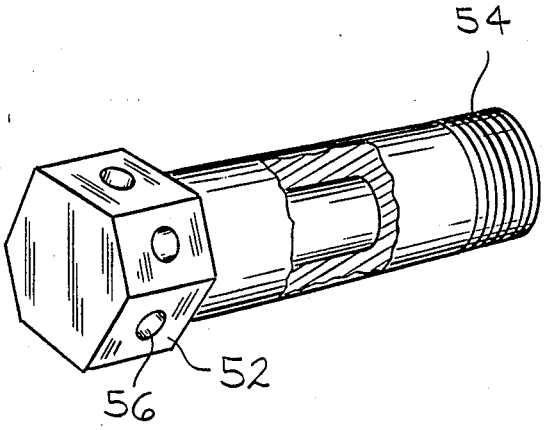
FIG. 3 is a pictorial view of the gas nozzle used with the combustors according to this invention.

A combustible gas is introduced into combustion chamber tube 44 through gas nozzle 52. As best shown in FIG. 3, gas nozzle 52 includes a central gas passage 54 and a plurality of radially directed gas outlet passages 56. The combination of the swirling flow of air introduced into chamber cylinder 44 through inlets 46 and the radial flow of gas out of gas nozzles outlet passages 56 serves to provide a highly turbulent combustible gas flow within the chamber which provides for efficient and clean combustion. Ignition plug 58 is provided to initiate combustion.

Heat exchanger wall 60 surrounds engine 10 and serves to confine hot gases from combustion chamber tubes 44 within heat exchangers 20. Radially outside of wall 60 are counterflow heat exchangers 62. As shown by the phantom line arrows, exhaust gases are permitted to flow through heat exchangers 62 and escape between walls 60 and 64. Inlet air also passes through heat exchanger 62 from air inlet 66 formed between annular walls 64 and 68 as shown by full line arrows in FIG. 1. Inlet air is accordingly heated through heat exchange with the exhaust gases to provide enhanced thermal efficiency of engine 10. Wall 68 also forms a radially inward flange 72 which communicates with the closed end of combustion tubes 44 by bellows 74 which also provides a gas seal while permitting movement of the relative components in response to temperature changes. The region between wall 68 and outer housing 78 is packed with a thermal insulating material 80.

Due to the relatively small size and mass of combustion chamber tubes 44, heating of those elements does not cause a dramatic degree of thermal expansion. A relatively short warm-up time is provided as compared with systems in which a unitary combustion chamber assembly is used for heating an integrated heater head belonging to a number of Stirling engine cylinders. Moreover, the gas management approaches used within tubes 44 which produces a high level of turbulence provide excellent thermal and combustion efficiencies and low output emissions.

While the above description constitutes the preferred embodiments of the present invention, it will be appreciated that the invention is susceptible of modification, variation and change without departing from the proper scope and fair meaning of the accompanying claims.

I claim:

1. A Stirling engine comprising:

a plurality of heat transfer stacks having a cooler, regenerator and heat exchanger stacked end-to-end with a working cylinder adjacent each of said stacks and connected therewith by a hot connecting duct, said heat exchangers including an annular cluster of circumferentially spaced tubes extending from said regenerator in a substantially axial direction to an annular manifold axially spaced from said regenerator such that at any given time during operation of said Stirling engine working fluid in said tubes is flowing in a single axial direction through said heat exchanger, a combustion chamber on an end of each of said stacks having a gas flow outlet communicating with the interior of said heat exchanger tube cluster, air inlets for each of said combustion chambers for allowing air to enter the interior of said chambers, and a nozzle within said combustion chambers for introducing a combustible fuel within said combustion chambers, whereby said combustible fuel and air combust in said combustion chambers and generate hot gases which pass between said tubes applying heat to said heat exhanger.

2. A Stirling engine according to claim 1 further comprising an inlet air heat exchanger which transfers heat from said hot gases escaping said heat exchanger to fresh air which is conducted into said combustion chambers through said air inlets.

3. A Stirling engine according to claim 1 wherein said combustion chambers are tubes having a plurality of tangential slots which define said air inlets.

4. A Stirling engine according to claim 3 wherein said tangential slots are shaped to direct air to swirl within said combustion chambers.

5. A Stirling engine according to claim 3 wherein said nozzle has a plurality of individual fuel outlets which eject fuel in a radial direction relative to said combustion tubes.

6. A Stirling engine according to claim 1 wherein said combustion chambers comprise a tube having a longitudinal axis coaxial with said heat exchanger stacks.

7. A Stirling engine according to claim 1 further comprising a combustion chamber wall means for confining said hot gases from each of said combustion chambers to a single heat exchanger.

* * * * *